US006334438B1

(12) United States Patent
Itoh et al.

(10) Patent No.: US 6,334,438 B1
(45) Date of Patent: Jan. 1, 2002

(54) OVERHEAD VALVE TYPE INTERNAL COMBUSTION ENGINE

(75) Inventors: Katsuhiko Itoh; Masataka Eguchi; Ken Oike, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/493,202

(22) Filed: Jan. 28, 2000

(30) Foreign Application Priority Data

Jan. 28, 1999 (JP) ..... 11-019676

(51) Int. Cl.[7] ..... F01M 13/04
(52) U.S. Cl. ..... 123/572
(58) Field of Search ..... 123/572, 573, 123/574

(56) References Cited

U.S. PATENT DOCUMENTS 4,760,833 A * 8/1988 Tatyrek ..... 123/572
5,239,972 A * 8/1993 Takeyama et al. ..... 123/573
5,487,371 A * 1/1996 Beckman et al. ..... 123/572

FOREIGN PATENT DOCUMENTS

JP A 58-93914 6/1983

* cited by examiner

*Primary Examiner*—Marguerite McMahon

(57) ABSTRACT

An overhead valve type internal combustion engine having a breather chamber without increasing the size of the internal combustion engine by taking advantage of a space that is already formed. An overhead valve type internal combustion engine includes a cylinder bore formed in a cylinder, a freely rotatable cam shaft located in a cylinder head, and also located to the side of the cylinder bore viewed from a direction of a centerline of the cylinder, a chain chamber, located to the side of the cylinder bore, for housing a chain for rotationally driving the cam shaft, and a breather chamber located so as to be below the cam shaft and parallel to the cylinder bore on one side of the chain chamber.

10 Claims, 4 Drawing Sheets

OVERHEAD VALVE TYPE INTERNAL COMBUSTION ENGINE

BACKGROUND OF THE INVENTION

1. Field of the Invention

The present invention relates to the arrangement of a breather chamber of an overhead valve type internal combustion engine, for locating a cam shaft, rotatably driven by a transmission member such as a chain, in a cylinder head.

2. Description of Background Art

Japanese Patent laid-open No. Sho 58-93914 discloses technology related to the arrangement of a breather chamber of an overhead valve type internal combustion engine. In this related art technology, in an overhead valve V-type two cylinder internal combustion engine having a cam shaft rotatably supported in a cylinder head, a breather chamber is arranged in a space caused by an offset between the two cylinders arranged in a V shape, and is formed between a cylinder bore formed in a cylinder and a chain chamber housing a chain for driving a cam. Also, the breather chamber and the chain chamber are formed spread across a crankcase, a cylinder and a cylinder head.

SUMMARY AND OBJECTS OF THE INVENTION

In the above described related art technology, the breather chamber is arranged taking advantage of a space already formed by the cylinder arrangement peculiar to V-type internal combustion engines, which means that there is no need to make a new space in order to arrange the breather chamber. However, with respect to the chain chamber, the cylinder bore and the breather changer are arranged in series, which means that if this arrangement is adopted by a third party in an internal combustion engine having a cylinder arrangement that is other than V-type or horizontally opposed, there will be a need to make a new space in order to arrange the breather chamber between the chain chamber and the cylinder bore, and the internal combustion engine will become large.

The present invention therefore aims to provide an overhead valve type internal combustion engine that is V-type or horizontally opposed, or indeed an overhead valve type internal combustion engine having any other cylinder arrangement, in which a breather chamber having a required capacity can be arranged without increasing the size of the engine, by taking advantage of a space that has already been formed.

A first aspect of the present invention is an overhead valve type internal combustion engine, comprising a cylinder bore formed in a cylinder, a freely rotatable cam shaft located in a cylinder head, and also located to the side of the cylinder bore viewed from a direction of a centerline of the cylinder, a housing chamber, located to the side of the cylinder bore, for housing a transmission member for rotationally driving the cam shaft, and a breather chamber located so as to be below the cam shaft and parallel to the cylinder bore on one side of the housing chamber.

According to this first aspect of the present invention, since a freely rotatable cam shaft located in the cylinder head is located to the side of the cylinder bore viewed from the direction of a centerline of the cylinder, a space is formed at the side of the cylinder below the cam shaft. Also, the breather chamber is located so that it is parallel to the cylinder bore at the same side of the housing chamber for housing the transmission member for rotationally driving the cam shaft where the cylinder bore is located. As a result, the breather chamber is arranged taking advantage of a space that already exists formed below the cam shaft which means that there is no need to make a new space in order to arrange the breather chamber. This means that it is possible to arrange a breather chamber having the required capacity without increasing the size of the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
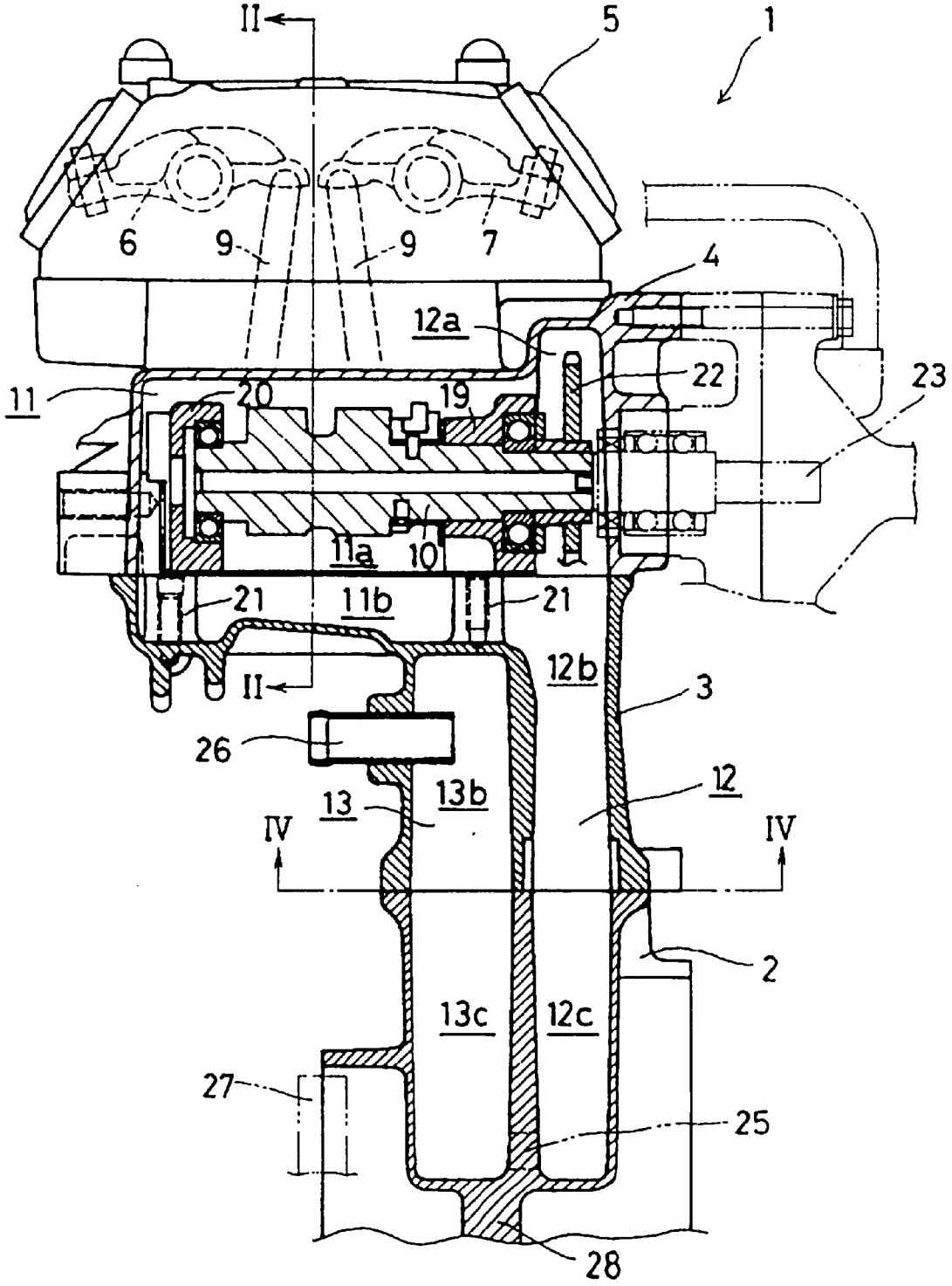
FIG. 1 is a schematic vertical cross sectional view of a cylinder head, a cylinder and a crankcase of an overhead valve type internal combustion engine of one embodiment of the present invention, taken along line I—I in FIG. 2 and FIG. 4.

One embodiment of the present invention will now be described below with reference to FIG. 1 to FIG. 4. An overhead valve type internal combustion engine 1, being the embodiment of the present invention, is an overhead valve, 4-valve single cylinder four-cycle water cooled internal combustion engine 1. FIG. 1 is a schematic vertical cross sectional view of a cylinder head 4, a cylinder 3 and a overhead valve type internal combustion engine of this internal combustion engine 1, with the cylinder 4 head being shown by the cross section along line I—I in FIG. 2, and the cylinder 3 and the crankcase 2 being shown by the cross section along line I—I in FIG. 4 located on a vertical surface connecting to an axial line of a balancer shaft arranged inside the crankcase 2 parallel to a crank shaft 18.

This internal combustion engine 1 is mounted in a vehicle such as a vehicle having a saddle, and the crank shaft 18 is oriented in a longitudinal direction of the vehicle. In the description of this embodiment, front, rear, left and right mean the front, rear, left and right sides of the vehicle.

The crankcase 2, cylinder 3, cylinder head 4 and cylinder head cover 5 of this internal combustion engine 1 are overlaid in this order, and are assembled so that they become a single unit. An intake rocker arm 6 and an exhaust rocker arm 7 respectively swingably supported by an intake rocker arm shaft and an exhaust rocker arm shaft are provided inside the cylinder head cover 5. These rocker arms 6 and 7 are swung by an intake cam and exhaust cam, formed on a rotating cam shaft 10, via valve lifters 8 (refer to FIG. 2) and push rods 9. On the other hand, two intake valves and two exhaust valves are fitted into the cylinder head, and the intake valves and exhaust valves respectively open an intake port and an exhaust port according to swinging of each of the rocker arms 6 and 7.

A cam chamber 11 encasing the cam shaft 10 and spread across the cylinder head 4 and cylinder 3, a chain chamber 12, being a housing chamber for housing a chain 14 acting as a transmission member and spread across the cylinder head 4, cylinder 3 and crankcase 2, and a breather chamber 13 spread across the cylinder 3 and the crankcase 2 are formed in this internal combustion engine 1. These chambers will be described in detail later.

Figure 2:
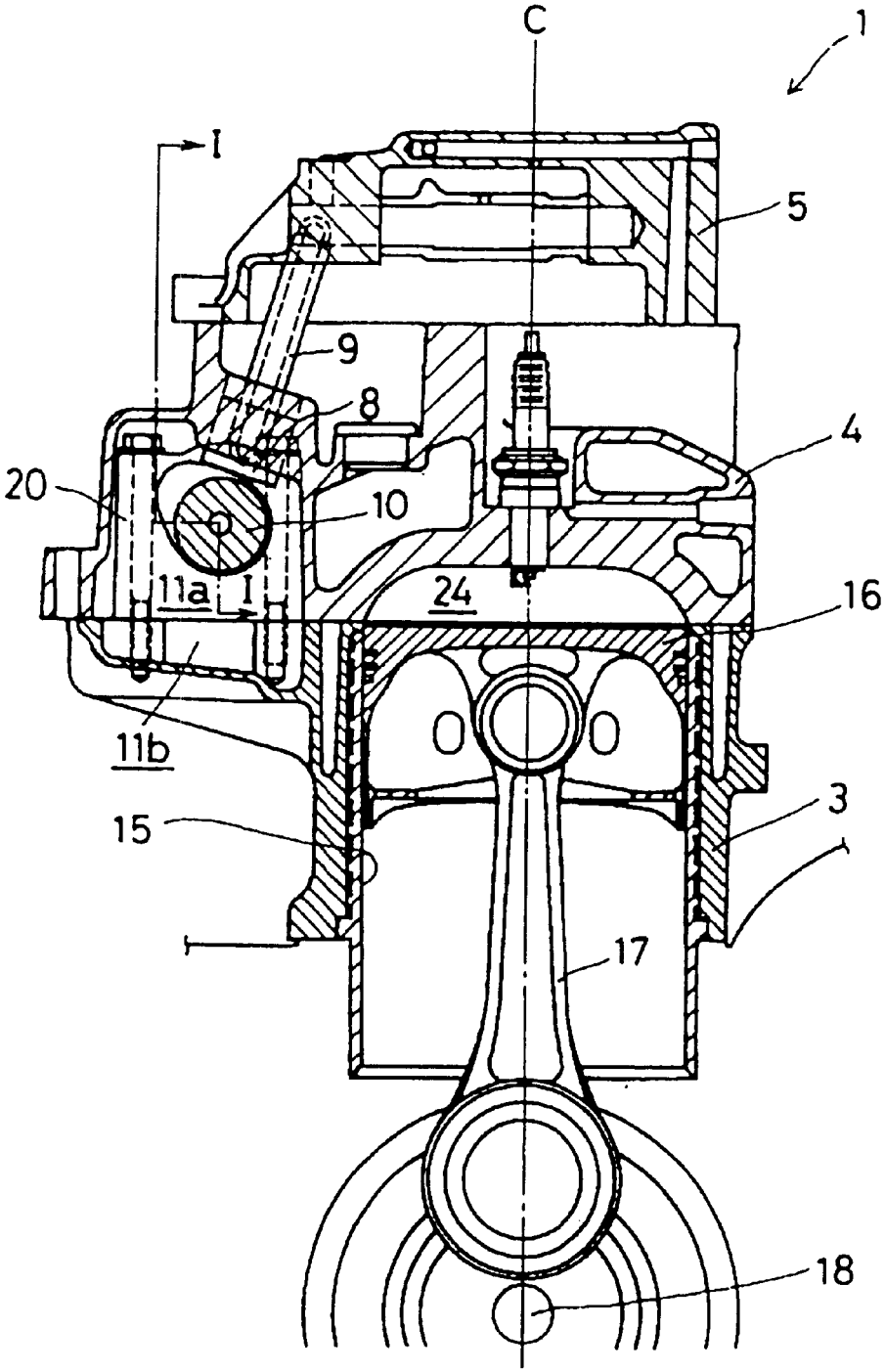
FIG. 2 is a cross-sectional drawing taken along line II—II in FIG. 1.

As shown in FIG. 2, a cylinder bore 15 is formed in the cylinder 3, and a piston 16 is fitted into the cylinder bore 15 so as to be capable of reciprocating movement. This piston 16 is connected to the crank shaft 18 via a connecting rod 17.

Figure 3:
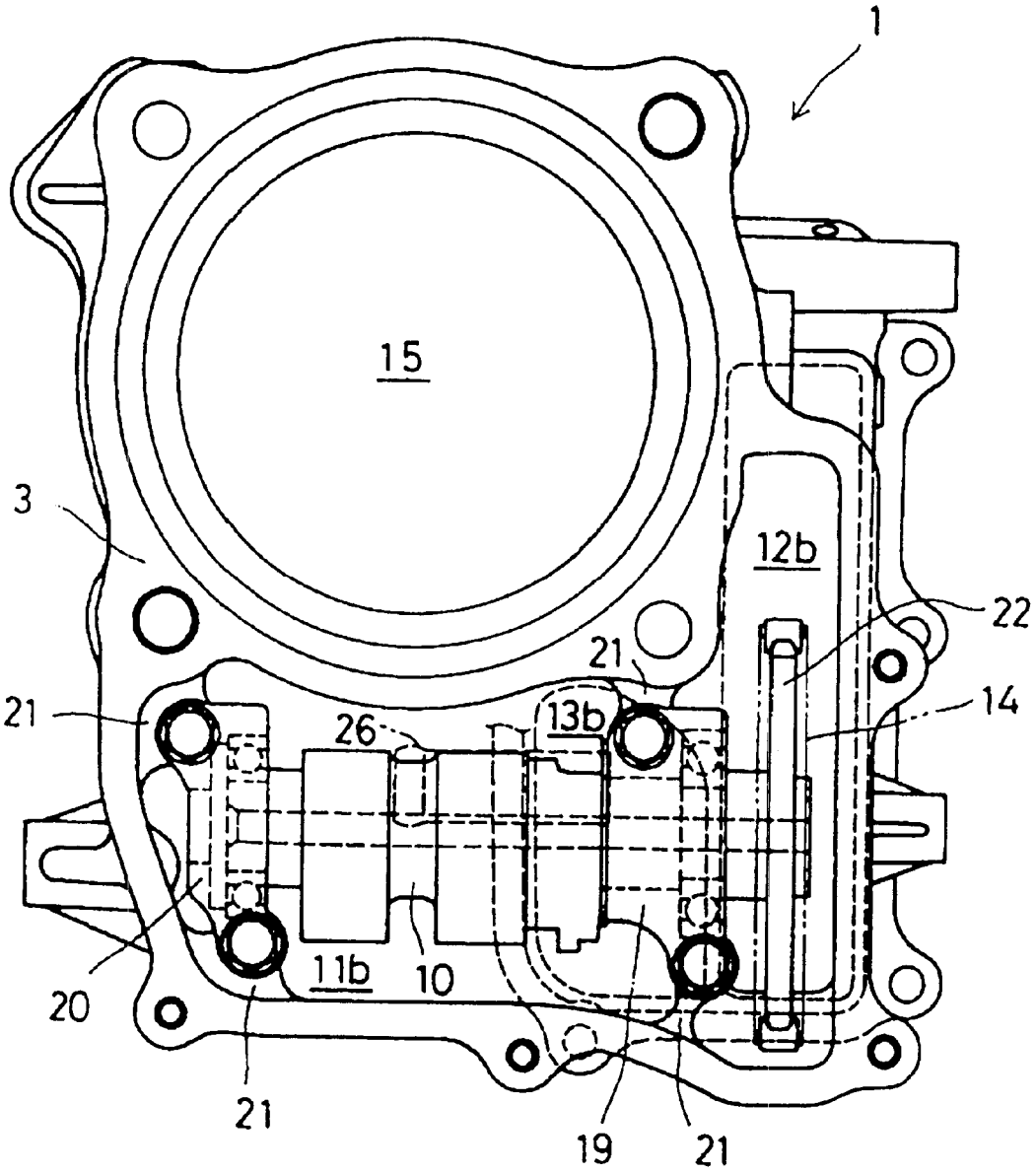
FIG. 3 is a plan view of the overhead valve type internal combustion engine of FIG. 1 with a cylinder head cover and a cylinder head taken off.

The cam shaft 10 is arranged parallel to the crank shaft 18. As shown in FIG. 1 and FIG. 3, the cam shaft 10 is rotatably supported via bearing by front and rear cam holders 19 and 20 at both ends, which are held between sections (hereinafter referred to as cam forming sections) where intake cams and exhaust cams are formed. Each of the cam holders 19 and 20 are arranged on the same plane as the upper surface of the cylinder 3, are mounted on upper surfaces of two struts 21 formed on the cylinder 3, and are fixed using bolts respectively screwed into the struts 21.

A cam sprocket 22 is fastened to a front end of the cam shaft 10 protruding further forward than the front cam holder 19. The chain 14, being a transmission member for rotatably driving the cam shaft 10, is wrapped around the cam sprocket 22 and extends between the cam sprocket 22 and a driven sprocket that is fastened to the front end of the crank shaft 18, so that rotation of the crank shaft 18 is conveyed to the cam shaft 10. A groove is formed on the front end surface across the diameter of the cam shaft 10, a projection formed on a shaft of a cooling water pump 23 engages in this groove, and the cooling water pump 23 is driven by the cam shaft 10.

As shown in FIG. 3, the cam shaft 10 is located in the cylinder head 4, and viewed from a direction of a centerline C of the cylinder 3 (here, the centerline is the centerline of the cylinder bore 15) is located to the right side of the cylinder bore 15. Accordingly, as shown in FIG. 2, a space is formed at the side of the cylinder 3 below the cam shaft 10.

Next, description will be given of the cam chamber 11, the chain chamber 12 and the breather chamber 13.

As shown in FIG. 1 and FIG. 2, a hollow section opening out close to the cylinder 3 is formed in the cylinder head 4, and the cam shaft 10, both cam holders 19 and 20, and the cam sprocket 22 are housed in this hollow section. This hollow section is made up of a cylinder head side cam chamber 11*a* housing a cam forming section of the cam shaft 10 and both cam holder sections 19 and 20, and a cylinder head side chain chamber 12*a* housing the cam sprocket 22 and the chain 14.

Accordingly, the cam shaft 10 located in the cylinder head 4 becomes rotatably supported inside this cylinder head side cam chamber 11*a*. Also, this cylinder head side cam chamber 11*a* has the cam shaft arranged to the right of the cylinder bore 15 viewed from the direction of a cylinder centerline C, as described above, which means that it is located to the right of a combustion chamber 24 formed in the cylinder head 4. The valve lifter 8 is supported so as to move reciprocally at an upper wall of the cylinder head side cam chamber 11*a* (refer to FIG. 2).

On the other hand, as shown in FIG. 1, a cylinder side cam chamber 11*b* comprising a hollow section opening close to the cylinder head 4, at a position matching the opening of the cylinder head side cam chamber 11*a* close to the cylinder 3, and a cylinder side chain chamber 12*b* comprising through holes opening close to the cylinder head 4, and close to the crankcase 2 at a position matching the opening of the cylinder head side chain chamber 11*b* close to the cylinder 3 are formed in the cylinder 3.

Four of the above described struts 21 are formed in the cylinder side cam chamber 11*b*. Also, as shown in FIG. 3 and FIG. 4, the cylinder side chain chamber 12*b* has a cross section that is substantially elongated in a direction orthogonal to the cam shaft 10, viewed from the direction of a cylinder centerline C, and is located in front of the cylinder bore 15, and it is possible for the chain 14 wound between the cam sprocket 22 and the driven sprocket to move inside the cylinder side chain chamber 12*b*.

Figure 4:
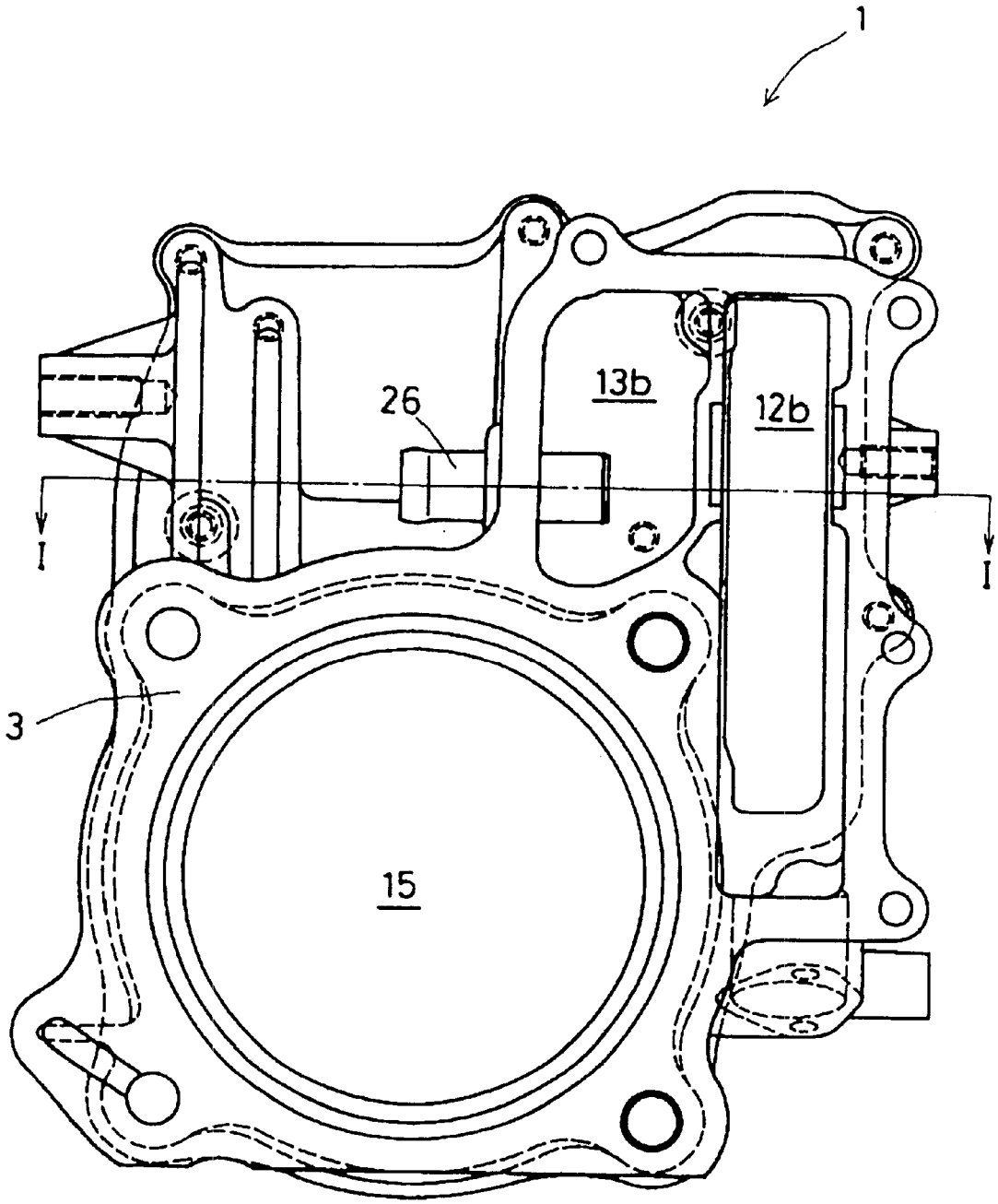
FIG. 4 is a cross sectional drawing taken along line IV—IV in FIG. 1.

Further, as shown in FIG. 1, FIG. 3 and FIG. 4, a cylinder side breather chamber 13*b* comprised of a hollow section opening out close to the crankcase 2 is formed in the cylinder 3. This cylinder side breather chamber 13*b* is directly below the cylinder side cam chamber 11*b* close to the chain chamber 12, and an upper wall of the cylinder side breather chamber 13*b* forms a lower wall of the cylinder side cam chamber 11*b*. The cylinder side breather chamber 13*b* also has substantially the same width in the lateral direction as the cylinder side cam chamber 11*b*.

A crankcase side chain chamber 12*c* comprising through holes opening close to the cylinder 3 and close to the driven sprocket of the crankshaft 18 at a position matching the opening of the cylinder side chain chamber 12*b* close to the crankcase 2 and crankcase side breather chamber 13*c* comprised of a hollow section opening out close to the crankcase 2 at a position matching an opening of the cylinder side breather chamber 13*b* close to the crankcase 2 are formed in the cylinder 3.

The chain chamber 12 and breather chamber 13 formed in this way will now be described.

As shown in FIG. 3 and FIG. 4, the breather chamber 13 is located below the cam shaft 10, to the right of the cylinder bore 15 and behind the chain chamber 12. Accordingly, the breather chamber 13 occupies part of a space formed based on the fact that the cam shaft 10 rotatably supported inside the cam chamber 11 is located to the side of the cylinder bore 15 viewed from the direction of the cylinder centerline C.

As has been described above, the chain chamber 12 is located in front of the cylinder bore 15, and obviously the cylinder bore is located behind the chain chamber 12, so that the breather chamber 13 and the cylinder bore 15 finally become located in parallel with each other behind the chain chamber 12.

Also, the capacity of the breather chamber 13 is appropriately set taking this function into consideration, but since a space remains behind the breather chamber, behind and below the cam chamber 11 housing the cam shaft 10, it is possible to make the capacity of the breather chamber large by taking advantage of this space.

A breather inlet 25 close to a lower wall of the breather chamber 13*c* is formed in a front wall close to the right of the crankcase side breather chamber 13*c*. As shown in FIG. 1, the front wall of the breather chamber 13 also functions as the rear wall of the chain chamber 12, but part of the front wall does not form the rear wall of the chain chamber 12 and is directly exposed inside the crankcase 2 where the driven sprocket fixed to the crankshaft 18 is located. A front wall of the crankcase side breather chamber 13*c* adjacent to a position where the breather inlet 25 is formed in a portion not forming the rear wall of the chain chamber 12, which means that the breather inlet 25 opens into the inside of the crankcase 2 at a side where the driven sprocket is arranged.

On the other hand, a breather outlet 26 is formed of a pipe inserted into a hole provided just above the rear wall of the cylinder side breather chamber 13*b*. The breather outlet 26 is connected to a clean side of an air cleaner (not shown) in the intake system, via a tube (not shown) connected to this pipe.

Also, a balancer 27 is arranged behind the rear wall of the breather chamber 13. One end of a balancer shaft is rotatably supported by a bearing, below a partitioning wall 28 of the crankcase forming the front wall of the breather chamber 13.

Since the embodiment of the present invention has the above described structure, the following effects are achieved.

The cam shaft 10 located in the cylinder head 4 and rotatably supported inside the cam chamber 11 is located to the right of the cylinder bore 15 viewed from the direction of the cylinder centerline C, which means that a space is formed to the right of the cylinder 3, below the cam shaft 10. Also, the breather chamber 13 is located in line with the cylinder bore 15, at a rear side of the chain chamber 12 housing the chain 14 for rotatably driving the cam shaft 10, being the same side as the side where the cylinder bore 15 is located. Therefore, the breather chamber 13 is arranged taking advantage of the above described space already formed below the cam shaft 10, which means there no need to make a new space in order to arrange the breather chamber 13. As a result, it is possible to arrange a breather chamber having the required capacity without enlarging the size of the internal combustion engine 1.

Also, the front wall of the breather chamber 13 also acts as the rear wall of the chain chamber 12, and both chambers are arranged close together, which means that it is possible to arrange the two chambers 12 and 13 compactly.

In the embodiment described above, the breather outlet 26 is provided in the rear wall of the cylinder side breather chamber 13*b*, namely in the cylinder 3, but the breather outlet can also be provided in the cylinder head 4. Specifically, by making the breather chamber so that is spreads across the cylinder head 4, the cylinder 3 and the crankcase 2, it is possible to provide the breather outlet in a cylinder head 4 side part of the breather chamber.

In the above described embodiment, the breather inlet 25 is formed in a front wall of the crank case side breather chamber 13*c*, but it is also possible for the breather inlet to be formed in a rear wall of the crankcase side breather chamber 13*c* so as to open out into the crankcase 2 at a side where the balance weight and balancer 27 of the crank shaft 18 are arranged, and holes for returning oil that has become separated inside the breather chamber 13 to the crankcase 2 at a side where the drive sprocket is arranged are preferably formed in the front wall of the crankshaft side breather chamber 13*c*.

In the embodiment described above, a chain 14 is used as the transmission member, but the transmission member can also be a belt or a gear. Also, the internal combustion engine 1 in the above described embodiment is a single cylinder engine, but the present invention is also applicable to an internal combustion engine having two or more cylinders, and it is also possible for the cylinder layout to be V-type or horizontally opposed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An overhead valve type internal combustion engine comprising:

a cylinder bore formed in a cylinder;

a freely rotatable cam shaft located in a cylinder head, and also located to a side of the cylinder bore viewed from a direction of a centerline of the cylinder;

a housing chamber, adjacent to the side of the cylinder bore, for housing a transmission member for rotationally driving the cam shaft;

a breather chamber located so as to be below the cam shaft and parallel to the cylinder bore on one side of the housing chamber; and a breather inlet being in communication with the housing chamber for providing communication between a crankcase and the breather chamber.

2. The overhead valve type internal combustion engine according to claim 1, wherein a breather outlet is in communication with said breather chamber and a clean side of an air cleaner in an intake system of the engine.

3. The overhead valve type internal combustion engine according to claim 1, wherein said housing chamber extends below said cam shaft and along the side of the cylinder bore and said breather chamber is positioned adjacent thereto with a common wall forming the housing chamber and the breather chamber.

4. The overhead valve type internal combustion engine according to claim 1, and further including a cam chamber disposed adjacent to and above said breather chamber, said cam shaft being rotatably positioned within said cam chamber.

5. The overhead valve type internal combustion engine according to claim 4, wherein said cam chamber and said housing chamber are in communication relative to each other.

6. An overhead valve type internal combustion engine comprising:

a cylinder, said cylinder including a cylinder bore being formed therein;

a cylinder head operatively mounted relative to said cylinder;

a freely rotatable cam shaft located in a cylinder head, said cam shaft being positioned to one side of the cylinder bore;

a housing chamber, adjacent to a first side of the cylinder bore, for housing a transmission member for rotationally driving the cam shaft; and a breather chamber located below the cam shaft and adjacent to the cylinder bore on the first side of the housing chamber; and a breather inlet being in communication with the housing chamber for providing communication between a crankcase and the breather chamber.

7. The overhead valve type internal combustion engine according to claim 6, wherein a breather outlet is in communication with said breather chamber and a clean side of an air cleaner in an intake system of the engine.

8. The overhead valve type internal combustion engine according to claim 6, wherein said housing chamber extends below said cam shaft and along the side of the cylinder bore and said breather chamber is positioned adjacent thereto with a common wall forming the housing chamber and the breather chamber.

9. The overhead valve type internal combustion engine according to claim 6, and further including a cam chamber disposed adjacent to and above said breather chamber, said cam shaft being rotatably positioned within said cam chamber.

10. The overhead valve type internal combustion engine according to claim 9, wherein said cam chamber and said housing chamber are in communication relative to each other.

* * * * *